United States Patent [19]

Baumann

[11] Patent Number: 4,475,920

[45] Date of Patent: Oct. 9, 1984

[54] METHOD FOR OBTAINING IMPROVED DYEINGS ON POLYAMIDE

[75] Inventor: Hans-Peter Baumann, Ettingen, Switzerland

[73] Assignee: Sandoz Ltd., Basel, Switzerland

[21] Appl. No.: 336,783

[22] Filed: Jan. 4, 1982

[30] Foreign Application Priority Data

Jan. 10, 1981 [DE] Fed. Rep. of Germany ..... 3100559

[51] Int. Cl.[3] ..... D06M 3/30; D06P 1/39; D06P 1/66

[52] U.S. Cl. ..... 8/542; 8/541; 8/606

[58] Field of Search ..... 8/606, 541, 542; 564/292

[56] References Cited

U.S. PATENT DOCUMENTS

| | | | |
|---|---|---|---|
| 3,271,147 | 9/1966 | Bush | 8/606 |
| 3,449,057 | 6/1969 | Ward | 8/606 |
| 3,987,097 | 10/1976 | Matter et al. | 260/567.6 |
| 4,090,845 | 5/1978 | Petzold et al. | 8/606 |
| 4,304,910 | 12/1981 | Green et al. | 564/292 |
| 4,331,441 | 5/1982 | Dvorsky et al. | 8/542 |

FOREIGN PATENT DOCUMENTS

| | | | |
|---|---|---|---|
| 861515 | 6/1978 | Belgium . | |
| 0005223 | 11/1979 | European Pat. Off. . | |
| 2061533 | 6/1971 | France . | |
| 55-45860 | 3/1980 | Japan | 8/606 |
| 55-71884 | 3/1980 | Japan | 8/542 |
| 1591857 | 6/1981 | United Kingdom . | |

*Primary Examiner*—Maria Parrish Tungol

*Attorney, Agent, or Firm*—Gerald D. Sharkin; Richard E. Vila; Thomas C. Doyle

[57] ABSTRACT

The present invention relates to a textile treatment process which comprises applying to a textile substrate of natural or synthetic polyamide either before or after dyeing, a compound of formula I,

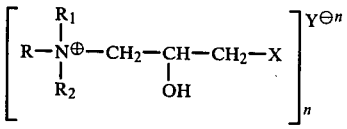

I in which

R is an $C_{6-20}$alkyl radical, each of $R_1$ and $R_2$, independently, is $—CH_2—CHOHCH_2—X$ or $C_{1-4}$alkyl, with the proviso that the total number of carbon atoms in $R+R_1+R_2$ is from 8 to 26;

X is chlorine or bromine,

Y is a non-chromophoric anion, and n is a whole number from 1 to 3, which treatment before dyeing increases the affinity of the substrate for anionic dyestuffs and after dyeing improves the wet-fastness of the dyed substrate.

33 Claims, No Drawings

METHOD FOR OBTAINING IMPROVED DYEINGS ON POLYAMIDE

The present invention relates to treatment processes for substrates consisting of or comprising natural or synthetic polyamides to increase the affinity thereof for acid dyestuffs and to increase the wet-fastness of the dyed substrates.

Accordingly, the present invention provides a process for treating textile substrates consisting of or comprising natural or synthetic polyamides comprising applying to the substrate either before dyeing or after dyeing a compound of formula I

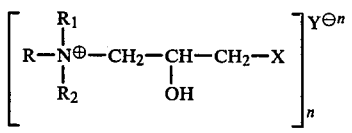

I in which

R is an $C_{6-20}$alkyl radical, each of $R_1$ and $R_2$, independently, is $—CH_2—CHOHCH_2—X$ or $C_{1-4}$alkyl, with the proviso that the total number of carbon atoms in $R+R_1+R_2$ is from 8 to 26, X is chlorine or bromine, Y is a non-chromophoric anion, and n is a whole number from 1 to 3, with the proviso that the application of a compound of formula I before dyeing is effected from a neutral to alkaline medium.

Preferred compounds of formula I are those wherein R is $C_{8-14}$-, preferably $C_{8-12}$-, especially $C_{12}$-alkyl and especially those wherein each $R_1$ and $R_2$, independently, is $—CH_2CHOH—CH_2—X$ or $C_{1-2}$alkyl, especially methyl.

The nature of the non-chromophoric anion as Y is not critical. Preferred anions are $Cl^-$, $Br^-$, p-toluenesulphonyl, $SO_4^{--}$ or $PO_4^{---}$. More preferred are $Cl^-$, $Br^-$, or $SO_4^{--}$ especially $Cl^-$ or $SO_4^{--}$.

The compounds of formula I are known or may be prepared in accordance with known methods from available starting materials.

As stated above the treatment before dyeing is effected from a neutral to alkaline medium, preferably pH 7.0 to 9. Examples of suitable alkalis include sodium hydroxide, sodium bicarbonate, sodium carbonate and tri-sodium phosphate. Most preferably a weakly alkaline salt such as sodium bicarbonate is used. The treatment is most preferably effected from a medium having a pH of from 7.5 to 9.

The application of the compound of formula I after dyeing is suitably effected from a weakly acid, neutral or alkaline medium i.e. from a medium having a pH of from 4 to 10. The preferred alkali is sodium bicarbonate.

The process according to the present invention comprising treating the substrate before dyeing increases the affinity thereof for anionic dyestuffs as well as for anionic optical brighteners. The treatment after dyeing increases the wet-fastness of the dyeings.

The compound of formula I may be applied to the polyamide substrate by known methods, for example by printing with a paste containing the compound of formula I, padding or applying by the exhaust method.

The compounds of formula I may be made up into paste or solutions in accordance with known methods.

For example, pastes are made by mixing with the usual additives such as thickeners, stabilizers etc.

Suitably the printing pastes or padding solutions contain from 1 to 100 g/l compound of formula I, more preferably from 20 to 100 g/l, most preferably from 40 to 100 g/l compound of formula I. When the compound of formula I is applied by the exhaust method suitably from 1 to 15%, preferably 5 to 10% by weight compound of formula I, based on the substrate is employed. The liquor to goods ratio is suitably from 20:1 to 100:1.

It can be advantageous to add electrolyte such as sodium chloride to the treating medium in amounts of 100 g/l, preferably 10 to 50 g/l.

When the application of compound of formula I is effected with a paste or padding solution the paste and solution for the treatment before dyeing, and optionally for the treatment after dyeing, suitably contains from 1 to 20 g/l, more preferably 2 to 10 g/l alkaline salt. When the application is effected by the exhaust method the treatment bath for the treatment before dyeing and optionally for the treatment after dyeing suitably contains 0.5 to 2.5 g/l preferably 0.5 to 1 g/l alkaline salt.

After application of the compound of formula I by padding or printing fixation is effected. This may be done by treatment in saturated steam at 102° C. or hot steam at 120° C. to 180° C. or by dry heat treatment at 120° C. to 180° C. Fixation time of substrates treated before dyeing is suitably at least 5 minutes whereas fixation of substrates treated after dyeing is suitably effected for 2 to 10 minutes. When the compound of formula I is applied by the exhaust process no separate fixation step is needed since the fixation occurs during the exhaust treatment which is generally carried out at the boil for approximately 1 hour.

Subsequent to fixation the substrate is rinsed and where a dyeing is to be made, this will be done in accordance with known methods with or without an intermediate drying step. However, with the process of the present invention very satisfactory results are obtained without the intermediate drying step. Further, the treated and fixed substrate is stable on storage and thus may be stored as such before dyeing is made.

Further, the treatment of the substrate with compound of formula I does not deleteriously affect the quality of the fibre or of the dyeing.

The natural or synthetic polyamide substrates which can be treated in accordance with the present invention include those consisting of or comprising wool, silk, nylon 6, nylon 66, 11 etc.

The following Examples further serve to illustrate the invention. In the Examples all parts are by weight and all temperatures in degrees Centigrade.

PREPARATION OF QUATERNARY AMMONIUM SALT

Compound (a)

67.4 Parts (0.3 mol) technical 1-dimethylaminododecane (95%) are added to 36.3 parts water. The solution is adjusted to pH 6.6 with 39.1 parts (0.3 mol) hydrobromic acid. The mixture is heated to 90° (weak reflux) until the product is fully in salt form. Subsequently with cooling 27.8 parts (0.3 mol) epichlorohydrin are added dropwise over 20 minutes at 50°. After the addition, stirring is effected at 50° until the exothermic reaction dies away. The reaction product is a clear, jelly-like, thick mass. The product is stirred at 90° for 1 hour. After cooling a solid thick mass (pH value of the same 6.8–7.0) is obtained. The water is distilled off under a water stream vacuum for 2 hours at 130°. The reaction product of formula

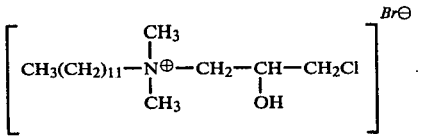

can be used as such without further purification.

In accordance with the above procedure and employing the starting materials of the following Table, further compounds of formula I can be prepared.

TABLE

| Compound | Amine | (Parts) | Water (Parts) | Acid | (Parts) | Epichlorohydrin (Parts) |
|---|---|---|---|---|---|---|
| (b) | I | 67.4 | 27.5 | XI | 29.4 | |
| (c) | I | 67.4 | 18 | XII | 33.7 | |
| (d) | II | 56.2 | 19.2 | XII | 29.4 | 27.8 |
| (e) | III | 47.2 | 27.7 | XIII | 39.1 | |
| f | III | 47.2 | 23.7 | XI | 29.4 | |
| g | III | 47.2 | 15.6 | XII | 29.4 | |
| h | IV | 82.5 | 29.1 | XII | 33.7 | 27.8 |
| i | IV | 82.5 | 38.9 | XI | 29.4 | |
| j | V | 59.0 | 21.0 | XII | 22.5 | |
| k | VI | 59.6 | 21.1 | XII | 22.5 | |
| l | VII | 46.5 | 15.8 | XII | 22.5 | 18.5 |
| m | VIII | 47.7 | 15.0 | XII | 22.5 | |
| n | IX | 70.5 | 24 | XII | 33.7 | |
| o | IX | 70.5 | 33.7 | XI | 29.4 | |
| p | X | 38.8 | 24.1 | XIII | 39.1 | |
| q | X | 38.8 | 10.4 | XII | 33.7 | 27.8 |
| r | X | 38.8 | 20.1 | XI | 29.4 | |
| s | X | 38.8 | 16.3 | XIV | 86.1 | |

I = Dimethylaminododecane (95%)
II = Dimethylaminododecane
III = Dimethylaminoctane
IV = Dimethylaminohexadecane
V = Dimethylamino-talgalkylamine
VI = Dimethylamino-talgalkylamine (hydrated)
VII = Dimethyl($C_{12-16}$)alkylamine (30% $C_{14}$, 40% $C_{12}$ and 10% $C_{16}$)
VIII = Dimethyl($C_{12-16}$)alkylamine (69% $C_{12}$, 25% $C_{14}$ and 6% $C_{16}$)
IX = Dimethylcocoamine
X = Dimethylaminohexane
XI = $H_2SO_4$ (50%)
XII = HCl (32.5%)
XIII = HBr (62%)
XIV = p-toluenesulphonic acid Employing 46.8 parts (0.25 mol) dodecylamine, 105.5 parts water, 28.1 parts (0.25 mol) 32.5% hydrochloric acid and 69.4 parts (0.75 mol) epichlorohydrin and following the procedure described above a clear colourless solution containing 50% compound of formula t

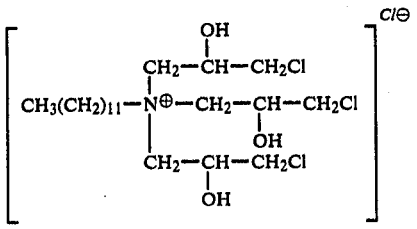

t is obtained

EXAMPLE 1

1000 Parts polyamide-6-tufting carpet looped 17 den. are dyed with 20 parts of the acid dyestuff of formula

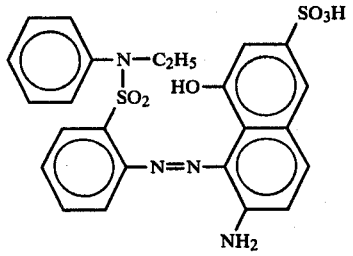

in the presence of 10 parts sulphonated castor oil and 40 000 parts water for 60 minutes at 98° C. After rinsing and drying the wet-fastness is poorish. However, after padding with 1000 parts solution containing 30 parts compound (a) and 15 parts sodium bicarbonate followed by drying at 140° in a stretch frame for 8 minutes the wet-fastness is improved.

EXAMPLE 2

1000 Part polyamide (Nylon 6.6), 17 den. staple fibre in the form of a tufted carpet are treated with 5000 parts of a solution containing 1.45 parts C.I. Acid Orange 156, 1.05 parts C.I. Acid Red 57, 1.23 parts C.I. Acid Blue 72, 4.0 parts carob bean thickener, 2.0 parts sodiumlauryldiglycolether sulphate, 2.0 parts monosodium phosphate and 0.3 parts disodiumphosphate and are subsequently exposed to saturated steam at 102° for 8 minutes, washed and dried. The dyeing has a wet-fastness (ISO test R 105/I-1959, Part 22) Grey Scale value of 3.5. After spraying with 500 parts of a solution containing 40 parts compound (b) and 5 parts sodiumbicarbonate and drying at 150° in a stretch frame for 8 minutes the wet fastness is improved.

EXAMPLE 3

A dyeing on polyamide 6 (Perlon) 2 den. (continuous fibre) with 3.4% C.I. Acid Orange 127, 0.66 C.I. Acid Red 299 and 1.68 C.I. Acid Blue 280 has a wash-fastness (ISO-test R 105/IV-1968, Part 10) Grey Scale value of 3. After padding (100% take-up) with 1000 parts of a solution containing 40 parts compound (t) and 20 parts sodium carbonate and drying for 4 minutes at 160° on a stretch frame an improvement in the wash-fastness is observed.

EXAMPLE 4

Polyamide-6- Yarn (Perlon, Tweed) is dyed by the exhaust method with 0.8% C.I. Acid Orange 156, 0.6% C.I. Acid Red 299 and 0.6% C.I. Acid Blue 40. The wet-fastness ISO-test R 105/I-1959, Part 22 Grey Scale value is 3. After heat-treatment for 2 minutes at 180° for 2 minutes in hot steam at 130° the Grey Scale value decrease to 2. The dyed fabric is treated in a bath (liquor to goods ratio 20:1) containing 2 g/l Compound (a) and 2.5 g/l sodium bicarbonate. After thermofixation or steam treatment the wet-fastness Grey Scale value is 5. Equally good results are obtained using 2.5 g/l Compound (j) or (k), 1.5 g/l Compound (l) or 2 g/l Compound (n).

EXAMPLE 5

The dyeing described in Example 4 is repeated. A wash-fastness Grey Scale value of 5 is achieved. After padding the dyeing with a solution containing 10 g/l Compound (m) and 5 g/l sodium carbonate (100% take up) followed by fixation at 140° for 5 minutes and subsequent rinsing with cold water.

Equally good results are obtained by replacing the sodium bicarbonate with sodium carbonate or by replacing Compound (m) with the same amount of Compounds (d), (e), (g).

EXAMPLE 6

2 Printing pastes containing 5 and 30 parts, respectively, of Compound (a), 5 and 10 parts, respectively, sodium carbonate, 5 parts tert.-octylphenylpoly(4-5)glycolether, 5 parts sodium lauryl alcohol diglicolether sulphate, 400 parts 8% sodium algenate and the rest water up to 1000 parts.

3.5 cm wide stripes spaced 2.5 cm from each other are printed on Helanca Tricot Nylon 66 fabric with these pastes, steamed for 10 minutes at 100° to 103° C. with saturated steam, rinsed and dyed without intermediate drying as follows: Sections of the printed fabric are dyed with the following anionic dyestuffs.

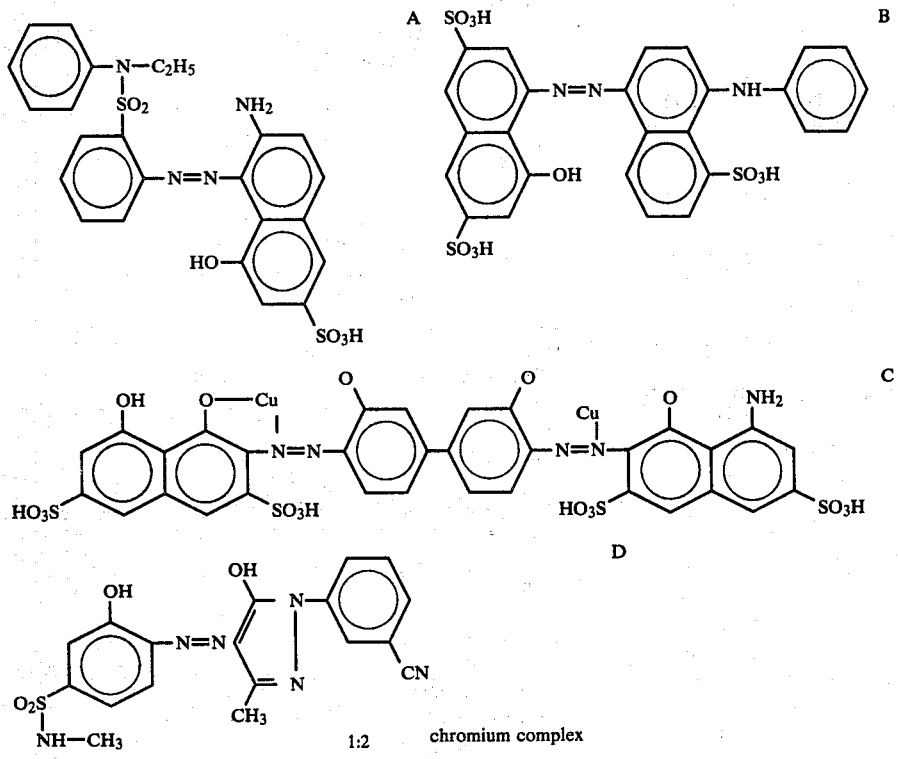

0.3% dyestuff is used and dyeing is effected for 60 minutes at 98° with a liquor to goods ratio of 50:1, whereby 2% acetic acid is added with Dyestuffs A, B and C and 4% ammonium sulphate is added with Dyestuff D. The dyed material is red in the case of Dyestuff (A), blue in the case of Dyestuff (B), greenish-blue with (C) and yellowish-red with (D) whereby the previously printed stripes are much more deeply dyed than the unprinted portions.

Employing the same procedure, but treating worsted wool yarn in place of the nylon 66 fabric, equally good results are obtained.

EXAMPLE 7

Nylon Helanca tricot is treated in a bath (liquor to goods ratio 20:1) with 5% based on the substrate Compound (o), 5 g/l sodium sulphate and approximately 1 g/l sodium bicarbonate (pH value c. 8) as follows: The textile is put in a bath at 40° and the bath is heated to 98° in 45 minutes and held at this temperature for 1 hour. The so-treated material is left to dry 2.5 g of the material is then dyed together with 2.5 g untreated material in the same bath with 0.75% C.I. Acid Red 57 Constitution No. 17053 in a liquor to goods ratio 40:1 using 10 ml of a buffer solution (pH 7) per 100 ml bath liquor. The buffer solution contains 11 g/l monosodiumphosphate. $2H_2O$ and 16.3 g/l dinatriumphosphate. The dyeing bath is heated from 40° to 98° C. in 45 minutes and held at 98° for 1 hour. The dyed fabrics are rinsed and dried. The treated material is dyed much more deeply than the untreated.

EXAMPLE 8

Employing the procedure of Example 7 but using the same amount of Compound (a) and instead of Compound (o) and 50 g/l sodium chloride in place of the 5 g/l sodium sulphate equally good results are obtained.

What is claimed is:

1. A process for treating a textile substrate consisting of or comprising natural or synthetic polyamide comprising applying to the substrate, either before or after dyeing, a compound of formula I,

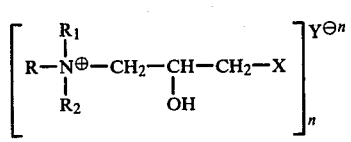

I in which

R is an $C_{8-20}$alkyl, each of $R_1$ and $R_2$, independently, is $—CH_2—CHOHCH_2—X$ or $C_{1-4}$alkyl, with the proviso that the total number of carbon atoms in $R+R_1+R_2$ is from 8 to 26,
X is chlorine or bromine,
Y is a non-chromophoric anion, and
n is a whole number from 1 to 3,
with the proviso that the application of a compound of formula I before dyeing is effected from a neutral to alkaline medium.

2. A process for increasing the wet-fastness of an anionic dyestuff on a polyamide-containing textile substrate which comprises applying to the substrate dyed with an anionic dyestuff an effective amount of a compound or mixture of compounds of formula I

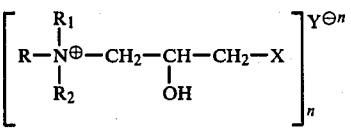

I in which
R is $C_{6-20}$alkyl, each of
$R_1$ and $R_2$, independently, is $—CH_2—CHOHCH_2—X$ or $C_{1-4}$alkyl, with the proviso that the total number of carbon atoms in $R+R_1+R_2$ is from 8 to 26,
X is chlorine or bromine,
Y is a non-chromophoric anion, and
n is a whole number from 1 to 3.

3. A process according to claim 2 in which, in the compound of formula I,R is $C_{12}$alkyl, $R_1$ and $R_2$ are methyl and X is chlorine.

4. A process according to claim 3 in which, in the compound of formula I, Y is $Cl^-$, $Br^-$ or $SO_4^{--}$.

5. A process according to claim 2, in which the compound of formula I is applied from an alkaline medium.

6. A process according to claim 2 wherein the compound of formula I is applied from a medium having a pH of 4 to 10.

7. A process according to claim 6 wherein, in the compound of formula I, R is $C_{8-14}$alkyl and each of $R_1$ and $R_2$, independently, is $—CH_2CHOHCH_2X$ or $C_{1-2}$alkyl and said compound is applied in a printing paste or padding liquor containing 40 to 100 g/l of said compound or from an exhaust liquor containing said compound in an amount of 1 to 15% based on the weight of the substrate.

8. A process according to claim 7 in which, in the compound of formula I,R is $C_{12}$alkyl, $R_1$ and $R_2$ are methyl and X is chlorine.

9. A process according to claim 8 in which, in the compound of formula I, Y is $Cl^-$, $Br^-$ or $SO_4^{--}$.

10. A process for increasing the affinity of a polyamide-containing substrate for anionic dyestuffs which comprises applying to the substrate, from a neutral to alkaline medium, before dyeing with an anionic dyestuff, an effective amount of a compound or mixture of compounds of formula I

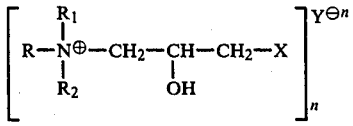

I in which
R is $C_{8-20}$alkyl, each of
$R_1$ and $R_2$, independently, is $—CH_2—CHOHCH_2—X$ or $C_{1-4}$alkyl, with the proviso that the total number of carbon atoms in $R+R_1+R_2$ is from 8 to 26,
X is chlorine or bromine,
Y is a non-chromophoric anion, and
n is a whole number from 1 to 3.

11. A process according to claim 10 wherein R is $C_{8-16}$alkyl.

12. A process according to claim 10 wherein R is $C_{8-14}$alkyl.

13. A process according to claim 12, in which the compound of formula I is applied to the substrate by printing, padding or by the exhaust process.

14. A process according to claim 13 wherein, in the compound of formula I, R is $C_{8-14}$alkyl and each of $R_1$ and $R_2$, independently, is $—CH_2CHOHCH_2X$ or $C_{1-2}$alkyl.

15. A process according to claim 13, in which the compound of formula I is applied from a printing paste or padding liquor containing 1 to 100 g/l compound of formula I.

16. A process according to claim 15, in which the paste or liquor contains 40 to 100 g/l compound of formula I.

17. A process according to claim 16 which includes the further step of fixing the compound of formula I on the substrate.

18. A process according to claim 13, in which the compound of formula I, is applied from an exhaust bath containing 1 to 15% by weight compound of formula I, based on the weight of the substrate.

19. A process according to claim 18, in which the exhaust bath contains 5 to 10% by weight, compound of formula I, based on the weight of the substrate.

20. A process according to claim 13, in which the compound of formula I is applied from a padding solution or paste containing 1 to 20 g/l alkaline salt.

21. A process according to claim 13, in which the compound of formula I is applied from an exhaust bath containing 0.5 to 2.5 g/l alkaline salt.

22. A process according to claim 13, in which the compound of formula I is applied from an alkaline medium.

23. A process according to claim 12 which further comprises the step of dyeing the treated substrate with an acid dye.

24. A process according to claim 12, in which R is $C_{12}$alkyl, $R_1$ and $R_2$ are methyl and X is chlorine.

25. A process according to claim 12 wherein the compound of formula I is applied from a medium having a pH of 7 to 9.

26. A process according to claim 25 which further comprises the step of dyeing the treated substrate with an acid dye.

27. A process according to claim 26 wherein the compound of formula I is applied from a printing paste or padding liquor containing 1 to 100 g/l of said compound or from an exhaust bath containing 1 to 15% by weight of said compound based on the weight of the substrate.

28. A process according to claim 27 which comprises applying the compound of formula I from a printing paste or padding liquor and fixing said compound on the substrate prior to dyeing.

29. A process according to claim 25 wherein, in the compound of formula I, R is $C_{8-14}$alkyl and each of $R_1$ and $R_2$ independently, is $—CH_2CHOHCH_2X$ of $C_{1-2}$alkyl and said compound is applied in a printing paste or padding liquor containing 40 to 100 g/l of said compound of from an exhaust liquor containing said compound in an amount of 1 to 15% based on the weight of the substrate.

30. A process according to claim 29 which further comprises the step of dyeing the treated substrate with an acid dye.

31. A process according to claim 29 in which, in the compound of formula I,R is $C_{12}$alkyl, $R_1$ and $R_2$ are methyl and X is chlorine.

32. A process according to claim 31 in which, in the compound of formula I, Y is $Cl^-$, $Br^-$ or $SO_4^{--}$.

33. a process according to claims 1, 15, 18, 20, 25 or 6, in which the treating medium contains electrolyte.

* * * * *